US006346927B1

(12) United States Patent
Tran et al.

(10) Patent No.: US 6,346,927 B1
(45) Date of Patent: Feb. 12, 2002

(54) AUTOMATIC VIDEO INPUT DETECTION/ SELECTION CIRCUITRY FOR A MONITOR WITH MULTIPLE VIDEO INPUTS

(75) Inventors: Thanh T. Tran; David W. Engler, both of Houston, TX (US)

(73) Assignee: Compaq Computer Corporation, Houston, TX (US)

( * ) Notice: Subject to any disclaimer, the term of this patent is extended or adjusted under 35 U.S.C. 154(b) by 0 days.

(21) Appl. No.: 09/183,944

(22) Filed: Oct. 31, 1998

(51) Int. Cl.[7] ..... G09G 5/00

(52) U.S. Cl. ..... 345/1; 345/132

(58) Field of Search ..... 345/1–3, 132, 345/213

(56) References Cited

U.S. PATENT DOCUMENTS 5,481,755 A * 1/1996 Harper et al. ..... 710/3
5,574,478 A * 11/1996 Bril et al. ..... 345/132
6,104,373 A * 8/2000 Klein ..... 345/132
6,104,376 A * 8/2000 Chang ..... 345/150

OTHER PUBLICATIONS

VESA® Plug and Display (P&D™) Standard, Version 1, Jun. 11, 1997, ©1997 Video Electronics Standards Association, pp. 1–5, 21–23, 100–107.

* cited by examiner

*Primary Examiner*—Lun-Yi Lao
(74) *Attorney, Agent, or Firm*—Akin, Gump, Strauss, Hauer & Feld

(57) ABSTRACT

A monitor having multiple video input ports and connectors is provided with automatic video input detection/selection circuitry. The circuitry may automatically detect when an external source such as a computer system is driving a video input port. The circuitry, for example, may detect whether a video input port is being driven by monitoring a sync signal (vertical or horizontal) for the video input port. A video input detect signal for a video input port may be generated from the sync signal for the video input port. In response to assertion of the video input detect signal indicating a source is driving a video input port, the circuitry may select the particular video input port. A microcontroller of the circuitry may provide a video input selector signal configured to select the video input port. When a single video input port is driven, user interaction is no longer necessary to select the particular video input port. If multiple video input ports are driven, a user may manually choose a particular video input port through a video selection button provided by an on-screen display of the monitor or by the computer system.

32 Claims, 3 Drawing Sheets

AUTOMATIC VIDEO INPUT DETECTION/ SELECTION CIRCUITRY FOR A MONITOR WITH MULTIPLE VIDEO INPUTS

BACKGROUND OF THE INVENTION

1. Field of the Invention

The present invention relates to monitors with multiple video inputs, and more particularly to automatic video input detection/selection circuitry.

2. Description of the Related Art

Today's monitors provide either a single video input port or dual video input ports. A video input port of a monitor allows for communication between a source (such as a computer system) and the monitor. For a monitor with a single video input port, switching the monitor to a different computer system has required significant user involvement. In particular, a computer user to accomplish such a system change must disconnect the current computer system from the video input port and connect the new computer system to the video input port. Due to the limited work space typically available to a computer user, the current computer system would likely be moved to a different work area and the new computer system would be located and brought into the user's work space. These manual tasks, which are needed whenever a user desires to switch a single-port monitor to a different computer system, not only may be time intensive, but also may exact undue physical exertion upon a computer user.

Although to a lesser degree, user involvement in video input port selection has even remained for dual-port monitors. For a monitor having dual video input ports, when a user desires the monitor to service a different computer system, it has yet been necessary for the user to manually choose a different video input port. For example, if a user were to switch physical connection of a computer system from on e video input port to another video input port, the monitor would maintain a logical connection with the video input port previously connected to the computer system. Only after the user manually chooses the video input port currently connected to the computer system, such as by pressing a video button, would the monitor switch its logical connection to the video input port currently connected to the computer system.

SUMMARY OF THE INVENTION

Briefly, in accordance with the present invention, a monitor having multiple video input ports and connectors is provided with automatic video input detection/selection circuitry. The circuitry may automatically detect when an external source such as a computer system is driving a video input port. The circuitry, for example, may detect whether a video input port is being driven by monitoring a sync signal (vertical or horizontal) for the video input port, A video input detect signal for a video input port may be generated from the sync signal for the video input port. In response to assertion of the e video input detect signal indicating a source is driving a video input port, the circuitry may select the particular video input port. A microcontroller of the circuitry may provide a video input selector signal configured to select the video input port. When a single video input port is driven, used interaction is no longer necessary to select the particular video input port. If multiple video input ports are driven, a user may manually choose a particular video input port by pressing a video selection button.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
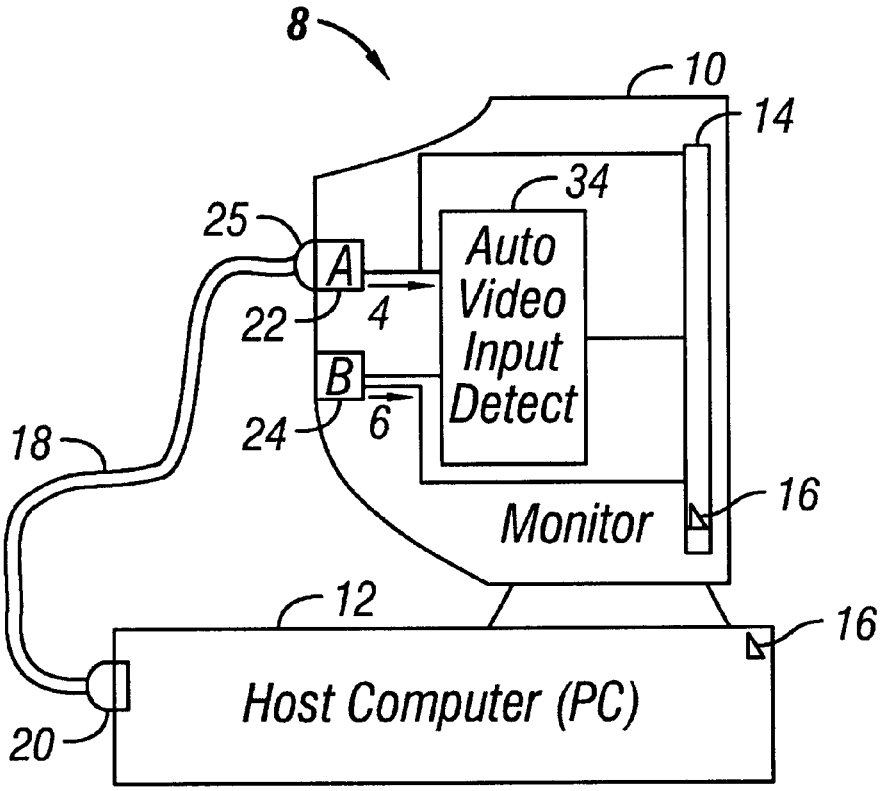
FIG. 1 is a side elevational view of a system including a host computer and a monitor with external surfaces removed to show internal automatic video input detect circuitry in accordance with the present invention.

Turning now to the drawings, FIG. 1 shows a system 8 including a host computer (PC) 12 and a dual-ported monitor 10 incorporating automatic video input detect circuitry 34 in accordance with the present invention. The host computer 12 may be connected to the monitor 10 through a monitor cable 18. In the illustrated system configuration, a connector 20 of the monitor cable 18 is connected to the host computer 12 and a connector 25 of the monitor cable 18 is connected to the monitor 10. The connector 25 may be connected to the monitor 10 through a video adapter A connector 22 (FIGS. 1 and 2) corresponding to an A video input channel or port 4 or a video adapter B connector 24 (FIGS. 1 and 2) corresponding to a B video input channel or port 6. Both connectors 22 and 24 are coupled to automatic video input detect circuitry 34. The automatic video input detect circuitry 34 is further coupled to an on-screen display 14 (such as a liquid crystal display, for example). The on-screen display 14 may include a video selection button 16 or alternatively the video select button 16 may be provided within the host computer 12. Operation and use of the automatic video input detect circuitry 34 and the video selection button 16 is described below. While certain video signals from the video adapter connector 22 and video adapter B connector 24 are directed to the automatic video input detect circuitry 34, other video signals may bypass the automatic video input detect circuitry 34. In the disclosed embodiment, the video adapter connectors 22 and 24 are compatible with the Video Graphics Adapter (VGA) standards or subsets or extensions thereof.

For ease of understanding, certain internal components of the monitor 10 and host computer 12 have been omitted. It should be understood that the system 8 may include host systems capable of driving a monitor 10 other than a computer 12. It should also be understood that the monitor 10 may be driven by various types of computers. In the context of the present invention, a monitor 10 generally refers to any video output device capable of displaying video information. Although a dual-ported monitor is illustrated in FIG. 1, it should be understood that the present invention is applicable to any monitor including a plurality of video input ports or a plurality of video adapter connectors. It should also be understood that the present invention is not limited to any particular type of monitor housing or a particular monitor form factor.

Figure 2:
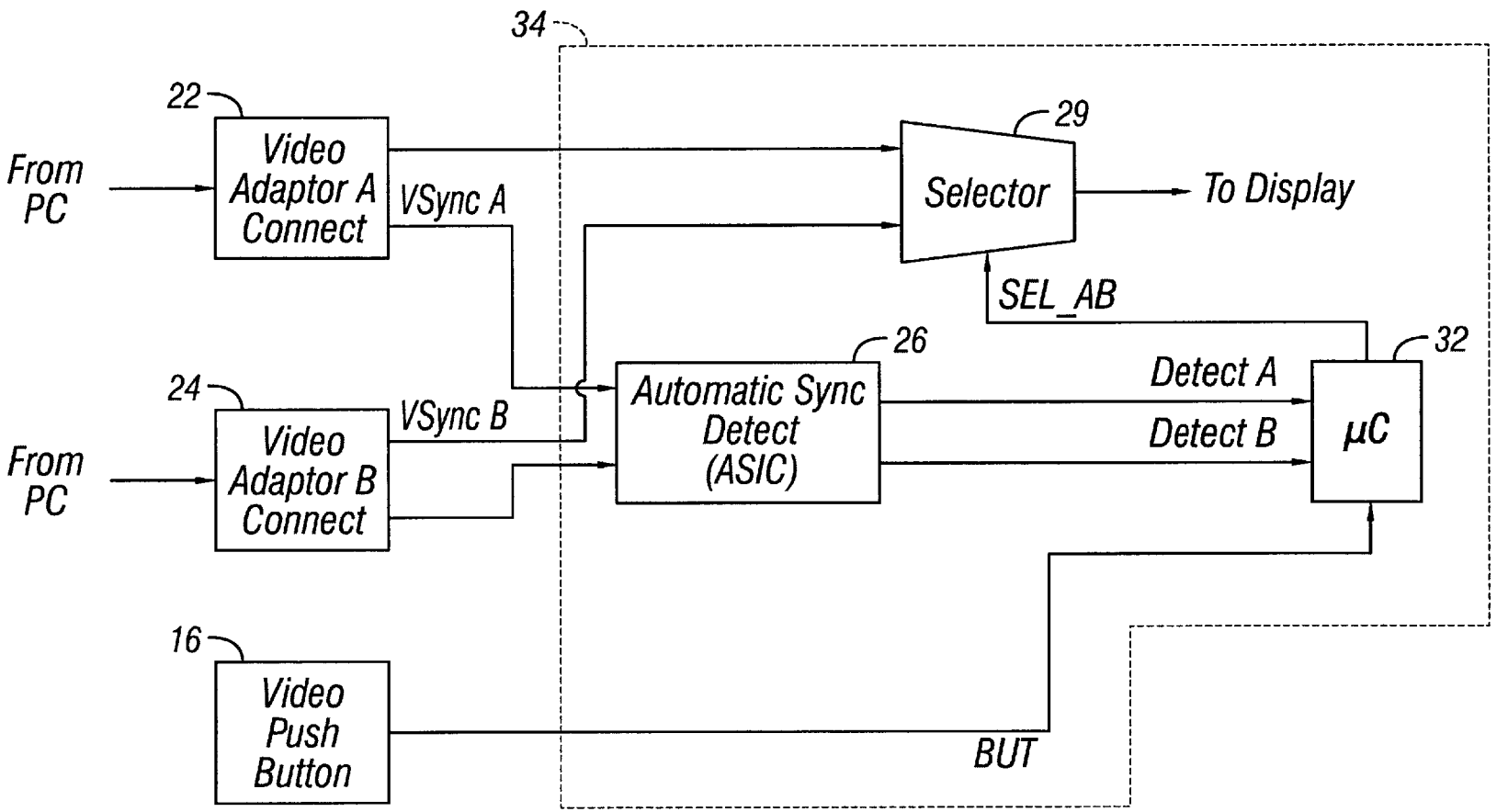
FIG. 2 is a schematic diagram of the video connectors of FIG. 1 and an exemplary embodiment of the automatic video input detect circuitry of FIG. 1 in accordance with the present invention.
Figure 3:
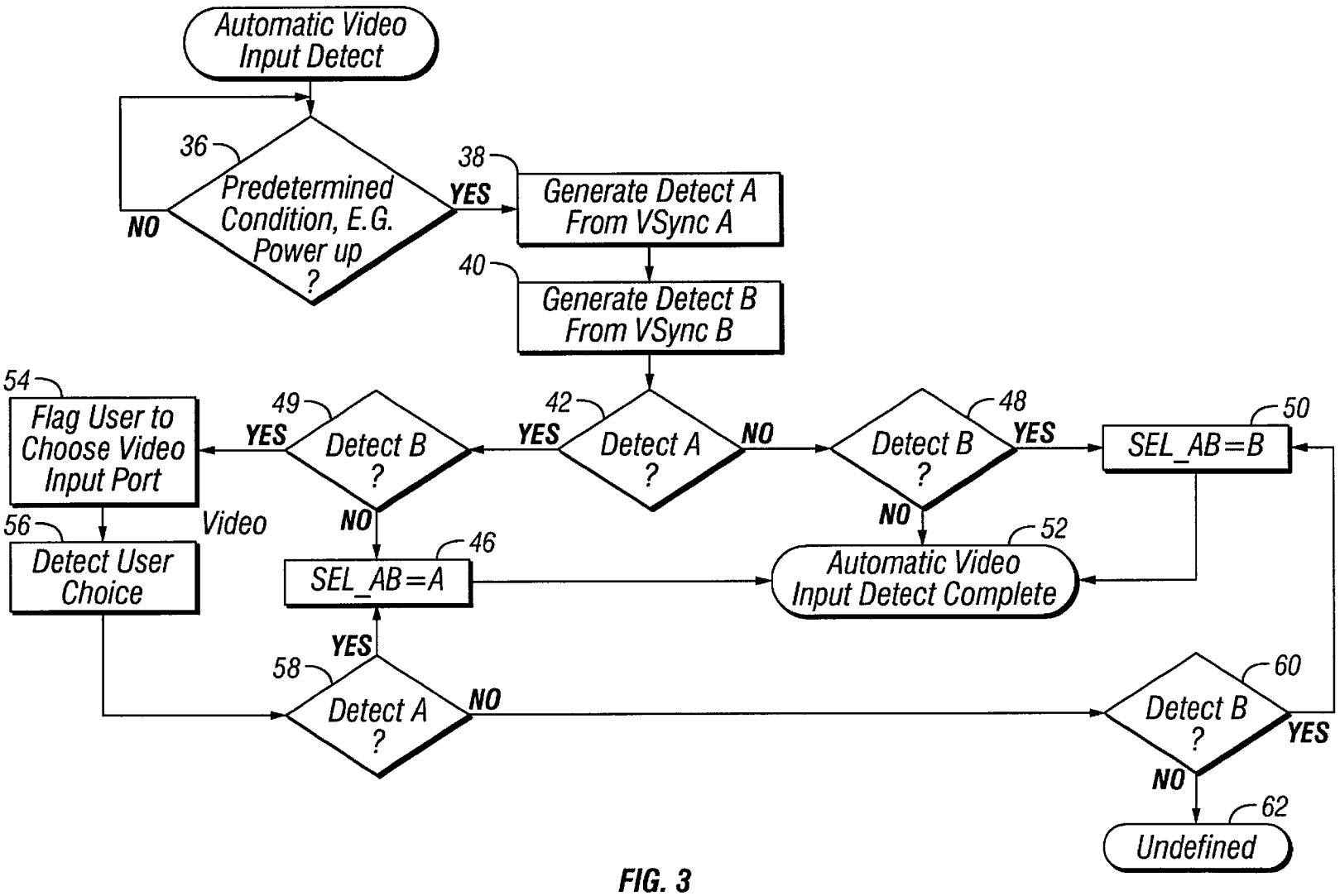
FIG. 3 is a flow chart of an automatic video input detect process in accordance with the automatic video input detect circuitry of FIGS. 1 and 2.

Referring to FIG. 2, a schematic diagram of the video adapter connectors 22 and 24 and an exemplary embodiment of the automatic video input detection circuitry 34 is shown. Referring to FIG. 3, a flow chart of an automatic video input detect process in accordance with the automatic video input detect circuitry 34 is shown. The automatic video input detect process (FIG. 3) is described in conjunction with the automatic video input detect circuitry 34 (FIG. 2). Each of the parenthetical references below referring to steps pertain to FIG. 3.

The automatic video input detect process is initiated following a predetermined condition, such as power up of the host computer 12, for example, (step 36). Entering and exiting a low power mode is preferably not the predetermined condition. The automatic video input detection circuitry 34 includes an automatic sync detect block 26, a microcontroller 32. and a video input selector 29. The automatic video input detection circuitry 34 may be implemented on a printed circuit board including typical video processing circuitry. Vertical sync signals VSYNC A and VSYNC B for the video adapter connectors 22 and 24 are provided to the automatic sync detect block 26. The sync signals provided to the sync detect block 26 may be vertical sync signals or horizontal sync signals. The currently preferred type of sync is a vertical sync signal, as a vertical sync signal is inactive during a sleep state and off state of the computer system S. From the vertical sync signal VSYNC A, the automatic sync detect block 26 generates a video input detect signal DETECT A (FIG. 2 and step 38). From the vertical sync signal VSYNC B, the automatic sync detect block 26 generates a video input detect signal DETECT B (FIG. 2 and step 40). In the disclosed embodiment, the automatic sync detect block 26 is the an application specific integrated circuit (ASIC) configured or customized in accordance with the automatic video input detect process. It should be appreciated by those skilled in the art that the sync detect block 26 may be implemented as a simple state machine. The video input detect signals DETECT A and DETECT B are provided from the automatic sync detect block 26 to the microcontroller 32. In the disclosed embodiment, the microcontroller 32 is the 80C930HF available from Intel Corporation.

The microcontroller 32 reads the video input detection signals DETECT A and DETECT B and provides a video input selection signal SEL_AB to the video input selector 29 based on the state of the video input detection signals DETECT A and DETECT B. If the video input detection signal DETECT A is asserted (YES condition determined by step 42) and the video input detect signal DETECT B is deasserted (NO condition determined by step 44), then the video input selector signal SEL_AB is set to the video adapter A connector 22 (step 46). If the video input detect signal DETECT B is asserted (YES condition at step 48) and the video input detect signal DETECT A is deasserted (NO condition at step 42), then the microcontroller 32 sets the video input selector signal SEL_AB to the video adapter B connector 24 (step 50). When the video adapter A connector 22 is selected, then the host computer 12 or other system is driving the monitor 10 over channel A. If the video adapter B connector 24 is selected, then the host computer 12 or other system is driving the monitor 10 over a channel B. The automatic video input detect process is completed after a particular video adapter connector is selected (step 52). It should be understood that selection of a video input channel or port includes a logical connection of the monitor with the associated video adapter connector.

The microcontroller 32 provides a video input selector signal SEL_AB to the selector 29 (an analog switch, for example). If the video input selector signal SEL_AB is set to the video adapter A connector 22, then the selector 29 selects the A channel or port 4. If the video input selector signal SEL_AB is set to the video adapter B connector 24, then the selector 29 selects the B channel or port 6. The selector 29 provides video information (e.g., pixel information) from the video adapter connector corresponding to the selected channel or port to the display 14.

The automatic video input detect circuitry 34 essentially detects when a system is driving a particular channel or port through a corresponding video adapter connector and then selects the particular video adapter connector and channel. The automatic horizontal sync detect block 26 monitors the vertical sync signals VSYNC A and VSYNC B to detect when the A video input port 4 and the B video input port 6, which respectively correspond to the video adapter A connector 22 and the video adapter B connector 24, are being driven by the host computer 12 or other system. The automatic sync detect block 26 then generates video input detect signals DETECT A and DETECT B corresponding to the vertical sync signals VSYNC A and VYNC B. A transitioning level of a vertical sync signal VSYNC A or VSYNC B indicates that the video input port 4 or 6 is driven by a source. The transitioning level may be from active to inactive or from inactive to active.

The video input detect signals DETECT A and DETECT B are passed to the microcontroller 32. The microcontroller 32 reads the video input detect signals DETECT A and DETECT B and generates the video input selector signal SEL_AB set to a particular video adapter connector corresponding to the channel that is being driven by the host computer 12 or other system. The microcontroller 32 provides the video input selector signal SEL_AB to the selector 29 to select the particular channel 32. The selector 29 is then able to receive video information from the host computer 12 or other system over the selected channel.

The automatic video input detect circuitry 34 is also configured for manual selection by a user when both the video adapter A connector 22 and the video adapter B connector 24 are being driven. One system may be driving the video adapter A connector 22 and another system may be simultaneously driving the video adapter B connector 24. In such a case (YES condition at step 42 and YES condition at step 44), a user is flagged to choose a video input port (step 54) such as by displaying a message on the display 14. The user may choose a video input port by using the video selection button 16. The video selection button 16 may have a position corresponding to selection of the video adapter A connector 22 and a position corresponding to selection of the video selection button 16 by a user (step 56). Alternatively, the video selection button 16 may have a displaced position and a rest position. When the user pushes the video selection button 16 from a rest position to a displaced position, the previous setting of a video adapter connector may be switched to the other video adapter connector. If the video selection button 16 is not pressed by the user in a predetermined amount of time, then the previous setting of a video adapter connector may be maintained. It should be appreciated by those skilled in the art that a connector debounce block (not shown) in software may be coupled between the microcontroller 32 and the video selection button 16.

The video selection button 16 provides a button signal BUT to the microcontroller 21. If the state of the video selection button 16 reflects a choice of the video adapter A connector 22 by the user, then the microcontroller 32 interprets the signal BUT as the video input detection signal A (step 58). If the state of the video selection button 16 reflects a choice of the video adapter B connector 24 by the user, then the microcontroller 32 interprets the button signal BUT as the video input detect signal B (step 60). After interpreting the button signal BUT, the microcontroller 32 generates the appropriate video input selector signal SEL_AB to select the port and connector corresponding to the user's choice (steps 46 and 52). The button signal BUT may, for example, be a polled signal or an interrupt signal.

It should be understood that other ways for allowing a user to override an automatic video input selection are possible. It should further be understood that the automatic video input detection circuitry 34 may utilize signals other than vertical and horizontal sync signals to automatically detect driving of multiple video input ports.

The foregoing disclosure and description of the preferred embodiment are illustrative and explanatory thereof, and various changes in the components, circuit elements, signals, ports, monitor environments, and computer system environments, as well as in the details of the illustrated circuitry and construction and method of operation may be made without departing from the spirit of the invention.

We claim:

1. An automatic video input detection/selection circuit for a monitor, comprising:

automatic video input detection circuitry, comprising:

automatic sync detection circuitry for automatically monitoring transitioning levels of a plurality of sync signals corresponding to the plurality of video input ports and generating a video input selector signal based on the plurality of sync signals, wherein a transitioning level of a sync signal of the plurality of sync signals indicates a video input port of the plurality of video input ports corresponding to the sync signal is driven by a source external to the monitor, the plurality of video input ports providing a plurality of independent video data paths into the monitor; and automatic video input selection circuitry receiving the video input selector signal and selecting the video input port indicated by the video input selector signal.

2. The circuit of claim 1, the automatic video input detection circuitry comprising:

automatic sync detection circuitry for automatically detecting a plurality of sync signals corresponding to the plurality of video input ports.

3. The circuit of claim 2, wherein a transitioning level of a sync signal of the plurality of sync signals indicates a video input port corresponding to the sync signal is driven by a source external to the monitor.

4. The circuit of claim 1, the automatic video input detection circuitry comprising:

a detection signal generator for receiving the plurality of sync signals corresponding to the plurality of video input ports and generating a plurality of video input detection signals corresponding to the plurality of sync signals.

5. The circuit of claim 1, the automatic video input detection circuitry comprising:

a microcontroller for reading a plurality of video input detection signals corresponding to the plurality of sync signals.

6. The circuit of claim 1, the automatic video input selection circuitry comprising:

a microcontroller for driving a video input selector signal to select the video input port indicated by the video input selector signal.

7. A monitor adapted for automatic video input detection/selection, comprising:

monitor video circuitry, comprising:

a plurality of video input ports; and automatic video input detection/selection circuitry, comprising:

automatic sync detection circuitry for automatically monitoring transitioning levels of a plurality of sync signals corresponding to the plurality of video input ports and generating a video input selector signal based on the plurality of sync signals, wherein a transitioning level of a sync signal of the plurality of sync signals indicates a video input port of the plurality of video input ports corresponding to the sync signal is driven by a source external to the monitor, the plurality of video input ports providing a plurality of independent video data paths into the monitor; and automatic video input selection circuitry receiving the video input selector signal and selecting the video input port indicated by the video input selector signal.

8. The monitor of claim 7, the automatic video input detection circuitry comprising:

automatic sync detection circuitry for automatically detecting a plurality of sync signals corresponding to the plurality of video input ports.

9. The monitor of claim 8, wherein a transitioning level of a sync signal of the plurality of sync signals indicates if a video input port corresponding to the sync signal is driven by a source external to the monitor.

10. The monitor of claim 7, the automatic video input detection circuitry comprising:

a detection signal generator for receiving the plurality of sync signals corresponding to the plurality of video input ports and generating a plurality of video input detection signals corresponding to the plurality of sync signals.

11. The monitor of claim 7, the automatic video input detection circuitry comprising:

a microcontroller for reading the plurality of video input detection signals corresponding to the plurality of video input sync signals.

12. The monitor of claim 7, the automatic video input selection circuitry comprising:

a microcontroller for driving a video input selector signal to select the video input port indicated by the video input selector signal.

13. A method of detecting a video input port of a plurality of video input ports for a monitor, the plurality of video input ports including a first video input port and a second video input port, comprising the steps of:

reading a plurality of video input detection signals corresponding to a plurality of sync signals for the plurality of video input ports to detect the plurality of video input ports driven by a source external to the monitor, wherein a transitioning level of a sync signal of the plurality of sync signals indicates a video input port of the plurality of video input ports corresponding to the sync signal is driven by a source external to the monitor, the plurality of video input ports providing a plurality of independent video data paths into the monitor;

driving a video input selector signal to select the first video input port based on a first video input detection signal of the plurality of video input detection signals if the first video input port is driven by the source; and driving the video input selector signal to select the second video input port based on a second video input detection signal of the plurality of video input detection signals if the second video input port is driven by the source.

14. The method of claim 13, further comprising the step of:

flagging a user to manually choose a video input port of the plurality of video input ports if the first video input port is driven by a first source and the second video input port is driven by a second source.

15. The method of claim 13, further comprising the step of:

detecting a manual choice of the first video input port by the user; and driving the video input selector signal to select the first video input port.

16. The method of claim 13, further comprising the step of:

detecting a manual choice of the second video input port by the user; and driving the video input selector signal to select the second video input port.

17. The method of claim 13, further comprising the step of:

generating the plurality of video input detect signals from a plurality of sync signals corresponding to the plurality of video input ports.

18. The method of claim 13, wherein the source is a computer system.

19. Automatic video input detection/selection circuitry for a monitor, comprising:

an automatic detection means for automatically detecting driving of a video input port of a plurality of video input ports of the monitor, comprising:

automatic sync detection circuitry for automatically monitoring transitioning levels of a plurality of sync signals corresponding to the plurality of video input ports and generating a video input selector signal based on the plurality of sync signals, wherein a transitioning level of a sync signal of the plurality of sync signals indicates a video input port of the plurality of video input ports corresponding to the sync signal is driven by a source external to the monitor, the plurality of video input ports providing a plurality of independent video data paths into the monitor; and an automatic selection means receiving the video input selector signal and selecting the video input port indicated by the video input selector signal.

20. The circuitry of claim 19, further comprising:

a manual detection means for detecting a manual choice of a video input port of the plurality of video input ports by a user; and a selection means for selecting the video input port corresponding to the manual choice by the user.

21. A monitor adapted for automatic video input detection/selection, comprising:

a plurality of video input ports; and monitor video circuitry, comprising:

automatic video input detection/selection circuitry, comprising:

an automatic detection means for automatically monitoring transitioning levels of a plurality of sync signals corresponding to the plurality of video input ports and generating a video input selector signal based on the plurality of sync signals, wherein a transitioning level of a sync signal of the plurality of sync signals indicates a video input port of the plurality of video input ports corresponding to the sync signal is driven by a source external to the monitor, the plurality of video input ports providing a plurality of independent video data paths into the monitor; and an automatic selection means for receiving the video input selector signal and selecting the video input port indicated by the video input selector signal.

22. The monitor of claim 21, the monitor video circuitry further comprising:

a manual video input choice means for a user to manually choose a video input port of the plurality of video input ports.

23. The monitor of claim 21, the monitor video circuitry further comprising:

a video selection button for a user to manually choose a video input port of the plurality of video input ports.

24. A computer system adapted for automatic video input detection/selection, comprising:

a monitor, comprising:

a plurality of video input ports; and automatic video input detection/selection circuitry, comprising:

automatic sync detection circuitry for automatically monitoring transitioning levels of a plurality of sync signals corresponding to the plurality of video input ports and generating a video input selector signal based on the plurality of sync signals, wherein a transitioning level of a sync signal of the plurality of sync signals indicates a video input port of the plurality of video input ports corresponding to the sync signal is driven by a source external to the monitor, the plurality of video input ports providing a plurality of independent video data paths into the monitor;

automatic video input selection circuitry for receiving the video input selector signal and selecting the video input port indicated by the video input selector signal; and a host computer coupled to a video input port of the plurality of video input ports.

25. The computer system of claim 24, the automatic video input detection circuitry comprising:

automatic sync detection circuitry for automatically detecting a plurality of sync signals corresponding to the plurality of video input ports.

26. The computer system of claim 25, wherein a transitioning level of a sync signal of the plurality of sync signals indicates if a video input port corresponding to the sync signal is driven by a source external to the monitor.

27. The computer system of claim 24, the automatic video input detection circuitry comprising:

a detection signal generator for receiving the plurality of sync signals corresponding to the plurality of video input ports and generating a plurality of video input detection signals corresponding to the plurality of sync signals.

28. The computer system of claim 24, the automatic video input detection circuitry comprising:

a microcontroller for reading a plurality of video input detection signals corresponding to the plurality of sync signals.

29. The computer system of claim 24, the automatic video input selection circuitry comprising:

a microcontroller for driving a video input selector signal to select the video input port indicated by the video input selector signal.

30. A computer system adapted for automatic video input detection/selection, comprising:

a monitor, comprising:

a plurality of video input ports; and monitor video circuitry, comprising:

automatic video input detection/selection circuitry, comprising:

an automatic detection means for automatically detecting driving of a video input port of the plurality of video input ports comprising:

automatic sync detection circuitry for automatically monitoring transitioning levels of a plurality of sync signals corresponding to the plurality of video input ports and generating a video input selector signal based on the plurality of sync signals, wherein a transitioning level of a sync signal of the plurality of sync signals indicates a video input port of the plurality of video input ports corresponding to the sync signal is driven by a source external to the monitor, the plurality of video input ports providing a plurality of independent video data paths into the monitor;

an automatic selection means for receiving the video input selector signal and selecting the video input port indicated by the video input selector signal; and a host computer coupled to a video input port of the plurality of video input ports.

31. The computer system of claim 30, the monitor further comprising:

a manual video input choice s for a user to manually choose a video input port of the plurality of video input ports.

32. The computer system of claim 30, the monitor further comprising:

a video selection button for a user to manually choose a video input port of the plurality of video input ports.

* * * * *